United States Patent [19]

Dziki

[11] Patent Number: 4,457,457

[45] Date of Patent: Jul. 3, 1984

[54] APPARATUS FOR DISPENSING THERMOPLASTIC MATERIAL

[75] Inventor: Michael M. Dziki, Woodbury, Minn.

[73] Assignee: Minnesota Mining and Manufacturing Company, St. Paul, Minn.

[21] Appl. No.: 343,304

[22] Filed: Jan. 27, 1982

[51] Int. Cl.[3] ..... B05C 1/00

[52] U.S. Cl. ..... 222/146 HE; 219/230; 219/421

[58] Field of Search ..... 222/146 HE; 221/281; 219/230, 421

[56] References Cited

U.S. PATENT DOCUMENTS

| | | | |
|---|---|---|---|
| 3,587,930 | 6/1971 | Schultz et al. | 222/146 HE |
| 3,744,921 | 7/1973 | Weller et al. | 222/146 HE X |
| 3,818,930 | 6/1974 | Crum | 222/146 HE X |
| 4,178,876 | 12/1979 | Nicklas et al. | 222/146 HE X |

FOREIGN PATENT DOCUMENTS

| | | | |
|---|---|---|---|
| 2238494 | 4/1973 | Fed. Rep. of Germany | 221/281 |
| 2444137 | 4/1975 | Fed. Rep. of Germany | 222/146 HE |

OTHER PUBLICATIONS

Owner's Manual for 3M's Alpha 100 "Jet-Melt" Adhesive Applicator.

*Primary Examiner*—Joseph J. Rolla
*Assistant Examiner*—Frederick R. Handren
*Attorney, Agent, or Firm*—Donald M. Sell; James A. Smith; Robert W. Sprague

[57] ABSTRACT

A thermoplastic material-dispensing apparatus of the type wherein solid thermoplastic adhesive material is melted in a heated well and is dispensed from the apparatus due to force exerted on the molten material by means of a piston. The apparatus comprises a loading chamber which comprises an intermediate barrel section and a magazine. The intermediate barrel section is situated between the heated well and a piston chamber which houses the piston. The magazine is adapted to contain a plurality of thermoplastic adhesive slugs and to deliver the thermoplastic adhesive slugs to the intermediate barrel section when the intermediate barrel section is empty.

1 Claim, 7 Drawing Figures

APPARATUS FOR DISPENSING THERMOPLASTIC MATERIAL

BACKGROUND OF THE INVENTION

The present invention relates to apparatus for dispensing thermoplastic adhesives.

Thermoplastic adhesives are used in many manufacturing procedures and are typically applied to substrates in a molten state.

Apparatus for dispensing thermoplastic adhesives are well-kown in the art, one such apparatus being described in U.S. Pat. No. 3,587,930 (Schultz et al.). Unfortunately, conventional apparatus such as that disclosed in said U.S. Pat. No. 3,587,930 require inconvenient periodic reloading of the apparatus with hot-melt thermoplastic adhesive slugs as molten adhesive is dispensed from the apparatus. Reloading of the apparatus disclosed in said U.S. Pat. No. 3,587,930, for example, is accomplished by unlatching the end of the slug holding chamber, manually inserting a replacement slug in the chamber, and relatching the end of the chamber. As a result of this reloading procedure, dispensing of the adhesive is interrupted periodically for significant periods of time, thereby resulting in a significant amount of lost production time and possibly adversely affecting the performance of the thermoplastic adhesive since the adhesive is allowed to cool during each reloading procedure. This reloading procedure is also susceptible to human error as the operator must assure that the end of the slug holding chamber is properly latched after each reloading procedure.

SUMMARY OF THE PRESENT INVENTION

The present invention provides in a thermoplastic material-dispensing apparatus of the type wherein shaped, solid members of thermoplastic material are converted from a solid to a melted state in a heated well and the molten thermoplastic material is dispensed from said apparatus by piston means housed in a piston chamber adjacent said heated well, the improvement comprises a loading chamber situated between the heated well and the piston chamber, the loading chamber comprising an intermediate barrel section and a magazine, the barrel section comprising wall members defining a barrel chamber in axial alignment with the heated well, the barrel chamber being dimensioned to receive a single, shaped, solid member of thermoplastic material and allow passage therethrough to the heated well, said magazine comprising wall members defining a storage chamber for storing a plurality of the shaped, solid members of thermoplastic material in stacked relationship with their longitudinal axes parallel to the axis of the barrel section, the wall members further defining an entrance port for introducing the shaped solid members into the storage chamber, and an exit port communicating with the barrel chamber, the exit port being positioned and dimensioned to permit one of the shaped, solid members to pass therethrough into the barrel chamber in axial alignment with the axis of the barrel section, said magazine further comprising delivering means for delivering one of said shaped, solid members to the barrel chamber when the barrel chamber is empty.

In a preferred apparatus in accordance with the present invention, the magazine is situated above the barrel chamber and the members of thermoplastic adhesive material are delivered to the barrel chamber by gravity feed.

The dispensing apparatus of the present invention permits rapid, semi-automatic reloading of thermoplastic adhesive slugs into the barrel chamber of the apparatus due to the presence of a magazine which contains a plurality of the thermoplastic adhesive slugs and which delivers the thermplastic adhesive slugs to the dispensing chamber of the apparatus as they are needed. Also, the apparatus of the present invention conveniently permits placement of additional thermoplastic adhesive slugs into the magazine of the apparatus even while adhesive is being dispensed. Lost production time and any problems associated with the cooling of molten adhesive are minimized with the apparatus of the invention. Also, problems associated with human error in the operation of the apparatus are minimized due to the simplicity of the reloading procedure.

DESCRIPTION OF THE DRAWINGS

The invention will be further explained with reference to the accompanying drawings wherein.

Figure 1:
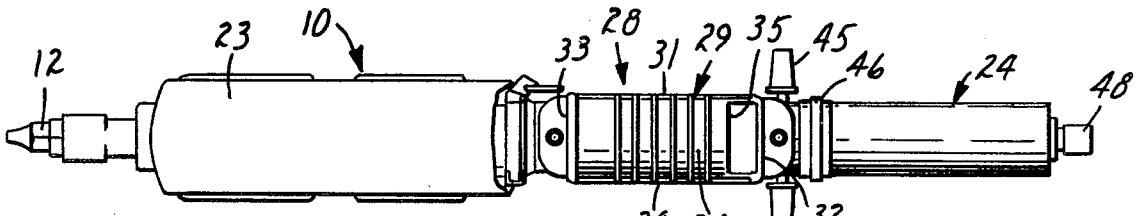
FIG. 1 is a top plan view of an apparatus in accordance with the present invention with some parts broken away.
Figure 2:
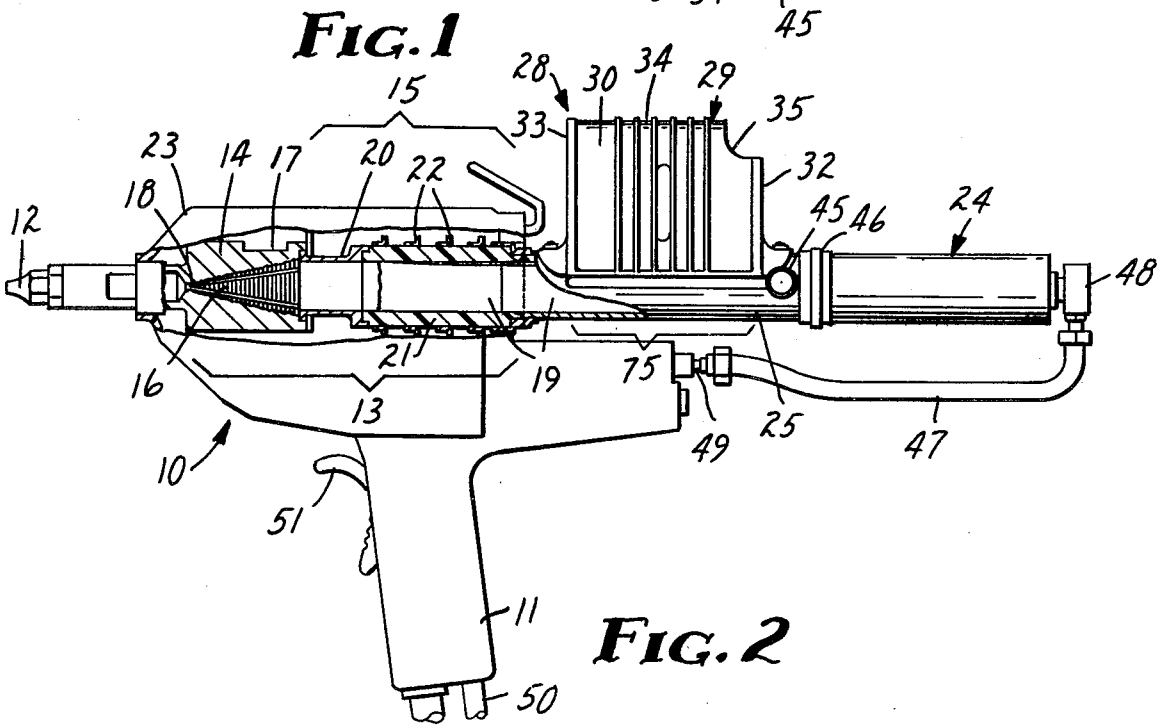
FIG. 2 is a side elevation view of the embodiment illustrated in FIG. 1 with some parts broken away and shown in section.

A preferred apparatus in accordance with the present invention is shown in FIGS. 1–5. Apparatus 10 comprises handle 11 and nozzle tip 12 which houses a shut-off valve (not illustrated) and which serves as the application tip through which the hot-melt adhesive is extruded. A preferred shut-off valve comprises a conventional inverted ball check valve. Apparatus 10 also comprises well 13 which is defined by hollow inner section or heating block 14 and outer section 15 which are in abutting and registering relationship. Inner section or heating block 14 comprises heating elements and has a conical internal design with stepped separations 16. This internal design for inner section or heating block 14 provides maximized melting capacity by increasing surface contact of inner section or heating block 14 with the thermoplastic adhesive slug. Thermostat 17 maintains the desired temperature of inner section or heating block 14. Inner section or heating block 14 terminates in orifice 18 which provides the means by which molten adhesive reaches nozzle tip 12.

Outer section 15 of well 13 is adapted to receive a cylindrical, thermoplastic adhesive slug 19 of cross section substantially identical to the internal cross section of outer section 15. The wall of outer section 15 is formed by cooling sleeves 20 and 21. Cooling sleeve 20 reduces heat conductivity, thereby preventing thermoplastic adhesive slug 19 from melting near the end of outer section 15 opposite inner member or heating block 14. Cooling sleeve 21 which comprises "Teflon TFE" (a polytetrafluoroethylene, commercially available from E. I. duPont De Nemours and Co.) provides additional heat insulation and, due to its low friction coefficient, allows smooth movement of the thermoplastic adhesive slug during the extrusion process and prevents sticking of solidified material to the walls. Metal rings 22 serve to preserve the shape of cooling sleeve 21 and to dissipate excessive heat. Heat shield 23 covers inner section or heating block 14, outer section 15 and electrical connections (not illustrated), thereby providing protection to the operator from heat and shock.

Figure 3:
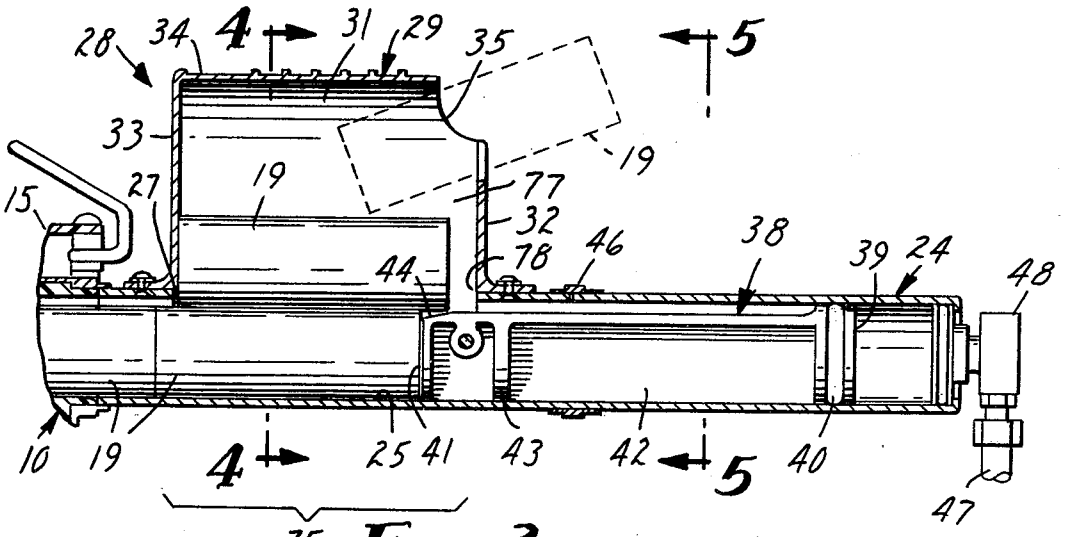
FIG. 3 is an enlarged sectional view taken along line 3—3 of FIG. 2.
Figure 4:
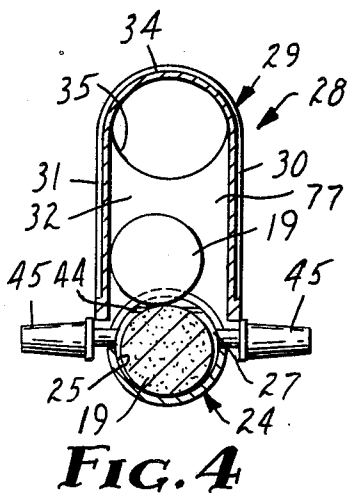
FIG. 4 is a sectional view taken along line 4—4 of FIG. 3.
Figure 5:
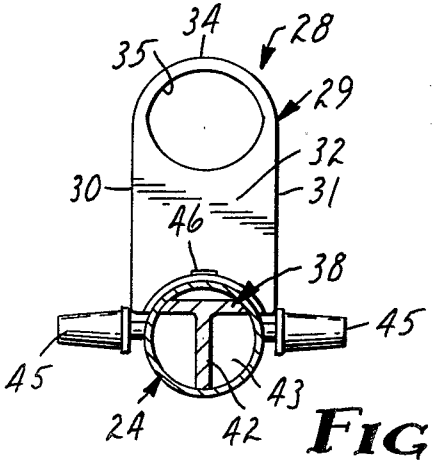
FIG. 5 is a sectional view taken along line 5—5 of FIG. 3.

As best illustrated in FIG. 3, it is seen that apparatus 10 further comprises loading chamber 28. Loading chamber 28 comprises intermediate barrel section 75 and magazine 29. Intermediate barrel section 75 is situated adjacent outer section 15 and comprises wall member 25 which defines barrel chamber 27. Barrel chamber 27 is in axial alignment with well 13 and is dimensioned so as to receive thermoplastic adhesive slug 19 therein and to allow passage of thermoplastic adhesive slug 19 therethrough to well 13. It is also seen that wall member 25 of intermediate barrel section 75 has an opening therein which is dimensioned to permit a thermoplastic adhesive slug to enter barrel chamber 27 in axial alignment with the axis of intermediate barrel section 75.

Magazine 29 which is the preferred magazine is situated adjacent intermediate barrel section 75 and is a single molded piece comprising two sidewall members 30 and 31, two end wall members 32 and 33, and top wall member 34. These wall members define and substantially enclose storage chamber 77 which is dimensioned so as to permit storage of two thermoplastic adhesive slugs 19 in a stacked relationship with their longitudinal axes parallel to the axis of intermediate barrel section 75. Endwall member 32 is shorter in height than endwall member 33 in order to provide entrance port 35 in magazine 29 through which thermoplastic adhesive slugs 19 can be inserted. Exit port 78 which is defined by sidewall members 30 and 31 and endwall members 32 and 33 communicates with barrel chamber 27 through the opening of intermediate barrel section 75. The location and dimension of exit port 78 permits passage of one thermoplastic adhesive slug 19 from storage chamber 77 of magazine 29 into barrel chamber 27 of intermediate barrel section 75 in axial alignment with the axis of intermediate barrel section 75. As illustrated in FIG. 3, sidewall members 30 and 31 and top wall member 34 are ribbed to provide strength and endwall members 32 and 33 are provided with concave ends to permit secure attachment of magazine 29 to intermediate barrel section 75. Since storage chamber 77 is substantially enclosed by sidewall members 30 and 31, endwall members 32 and 33 and topwall member 34, there is no opportunity for the operator's fingers to enter barrel chamber 27. Also, since storage chamber 77 is substantially enclosed, apparatus 10 may be tilted during extrusion of adhesive without the loss of thermoplastic adhesive slugs 19 from within magazine 29.

As is also best illustrated in FIG. 3, it is seen that apparatus 10 includes piston chamber 24. Piston chamber 24 is situated adjacent intermediate barrel section 75 and houses piston 38. Piston 38 comprises head 39 having o-ring 40 situated in a groove (not illustrated). Piston 38 also comprises pushing end 41 which is rigidly connected to head 39 by means of a T-shaped member 42 (best illustrated in FIG. 5). Piston 38 further includes stiffening member 43 attached to T-shaped member 42.

The pushing end 41 of piston 38 is provided with angle 44 so as to permit clearance between piston 38 and thermoplastic adhesive slug 36 within magazine 29. Retract levers 45 are attached to piston 38 and provide the means by which piston 38 may be fully retracted from its advanced position in order to permit loading of another thermoplastic adhesive slug 19 into barrel chamber 27. Piston chamber 24 further has associated therewith audio signal means or member 46 which is activated once piston 38 has advanced to its extreme forward position.

Piston 38 is caused to advance by means of compressed air which is supplied to piston chamber 24 by means of air hose 47, air hose 47 connecting valve housing 48 and fitting 49. Valve housing 48 includes a quick release valve which allows rapid evacuation of pressurized air from piston chamber 24, thereby facilitating rapid termination of the flow of molten adhesive through nozzle tip 12. An external line supplying compressed air is attached to apparatus 10 at fitting 50. Trigger 51 on handle 11 permits the passage of compressed air from the external source to piston chamber 24. Suitable trigger mechanisms by which the flow of compressed air is controlled are well known in the art and include, for example, the mechanism described is said U.S. Pat. No. 3,587,930, incorporated herein by reference. The degree of compression of trigger 51 determines the amount of air pressure exerted on piston 38. It is to be understood that piston 38 can be caused to advance by means of a hydraulic fluid, means for supplying a hydraulic fluid being well known in the art.

Figure 6:
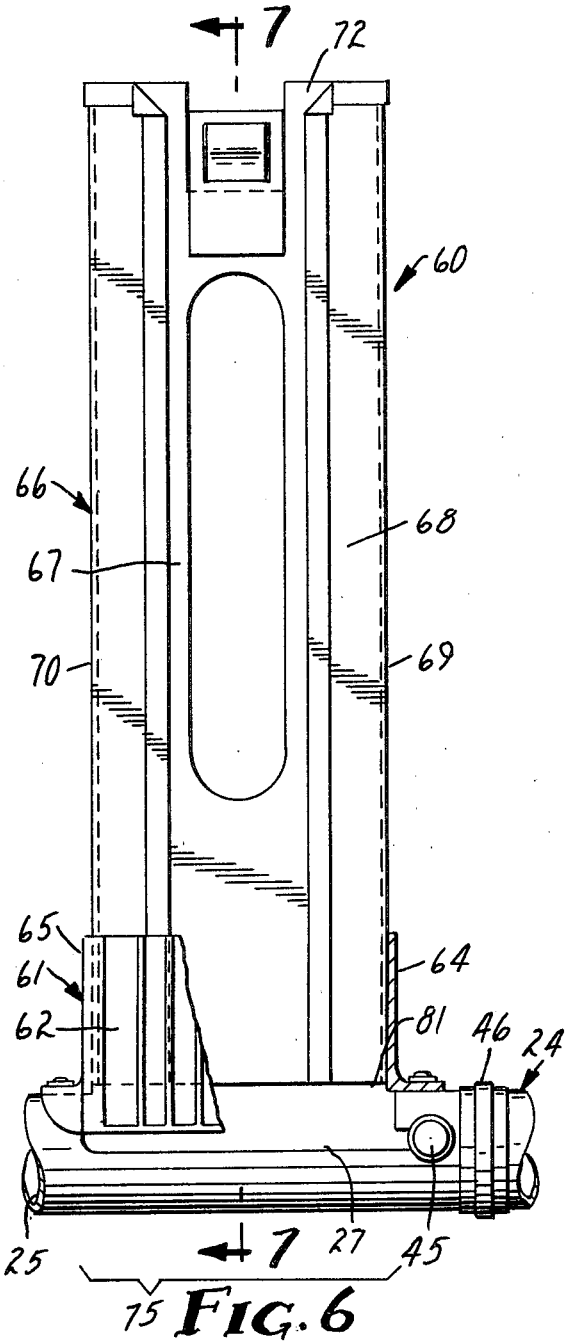
FIG. 6 is a side elevation view of a modified housing with some parts broken away and shown in section.
Figure 7:
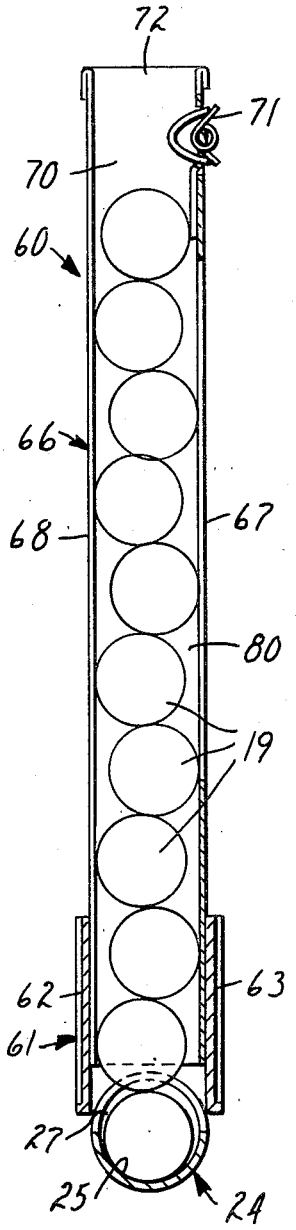
FIG. 7 is a sectional view taken along line 7—7 of FIG. 6.

A modified magazine 60 in accordance with the present invention is illustrated in FIGS. 6 and 7. Magazine 60 comprises a base structure 61 comprising two sidewall members 62 and 63 and two endwall members 64 and 65, base structure 61 being similar to magazine 29 except that there is no topwall member. Base structure 61 is mounted on intermediate barrel section 75 in a manner similar to that by which magazine 29 is mounted on intermediate barrel section 75. Inserted into base structure 61 is clip 66. Clip 66 comprises two sidewall members 67 and 68 and two endwall members 69 and 70. These wall members of clip 66 define storage chamber 80 which is dimensioned so as to permit storage of 10 thermoplastic adhesive slugs 19 in a stacked relationship with their longitudinal axes parallel to the axis of intermediate barrel section 75. Entrance port 72 which is defined by the wall members of clip 66 provides the means by which thermoplastic adhesive slugs 19 are inserted into magazine 60. Sidewall 67 includes spring 71 near entrance port 72 to retain the thermoplastic adhesive slugs 19 in magazine 60 when the dispensing apparatus tilted such as during extrusion of adhesive. Exit port 81 which is defined by the wall members of clip 66 communicates with barrel chamber 27 through the opening of intermediate barrel section 75. The location and dimension of exit port 81 of magazine 60 permits passage of one thermoplastic adhesive slug 19 from storage chamber 80 of magazine 60 into barrel chamber 27 of intermediate barrel section 75 in axial alignment with the axis of intermediate barrel section 75.

Discussing the operation of apparatus 10 of FIGS. 1–5, three thermoplastic adhesive slugs 19 are introduced into magazine when piston 38 is in a fully retracted position within piston chamber 24, the first of the thermoplastic adhesive slugs 19 falling into barrel chamber 27 by gravity feed when piston 38 is retracted fully (i.e., when the dispensing chamber is empty). Trigger 51 is compressed admitting compressed air into piston chamber 24 and causing piston 38 to advance forward. Advancement of piston 38 pushes the first thermoplastic adhesive slug 19 forward to a position within outer section 15. Once piston 38 has advanced to its extreme forward position, audio signal 46 sounds indicating to the operator that piston 38 has fully advanced. Piston 38 is retracted to within piston chamber 24 by first opening the quick release valve in valve housing 48 and then retracting retract levers 45, thereby allowing the second thermoplastic adhesive slug 19 which is contained in magazine 29 to fall by gravity feed into barrel chamber 27 which is again empty. Trigger 51 is them compressed causing advancement of piston 38. As piston 38 advances, it pushes the second thermoplastic adhesive slug 19 forward into outer section 15. The second thermoplastic adhesive slug 19 in turn pushes the first thermoplastic adhesive slug forward into the inner section or heating block 14 and causes it to contact the heating block. The forward end of the first thermoplastic adhesive slug 19 begins to melt and to form a constant reservoir of molten thermoplastic adhesive and, as piston 38 continues to advance and exert pressure on the first thermoplastic adhesive slug 19 and the molten thermoplastic adhesive preceeding it, molten thermoplastic adhesive is dispensed through nozzle tip 12.

It is to be understood that other variations and modifications can be made without departing from the spirit and scope of the invention.

What is claimed is:

1. A portable thermoplastic material-dispensing apparatus of the type wherein shaped, solid members of thermoplastic material are converted from a solid to a melted state in a heated well and the molten thermoplastic material is dispensed from said apparatus by piston means housed in a piston chamber adjacent said heated well, the improvement comprising a loading chamber situated between said heated well and said piston chamber, and a manually retractable piston, said loading chamber comprising an intermediate barrel section and a magazine, said intermediate barrel section comprising wall members defining a barrel chamber in axial alignment with said heated well, said barrel chamber being dimensioned to receive a single, shaped, solid member of thermoplastic material and allow passage therethrough to said heated well, said magazine being situated above said barrel chamber, comprising two sidewall members, a front endwall member, a back endwall member, and a topwall member which define and substantially enclose a storage chamber for storing a plurality of said shaped, solid members of thermoplastic material in stacked relationship with their longitudinal axis parallel to the axis of said barrel section, said magazine comprising an entrance port for introducing said shaped, solid members into said storage chamber, said entrance port being defined by adjacent openings in said top wall member, said sidewall members and said back endwall member, said back endwall member being of such a height that it extends above the bottom of the uppermost shaped, solid member when said storage chamber is filled with shaped, solid members, said entrance port permitting convenient placement and removal of shaped, solid members therein and therefrom while permitting said apparatus to be tilted without the loss of shaped, solid members from said magazine, and said wall members further defining an exit port communicating with said barrel chamber, said exit port being positioned and dimensioned to permit one of said shaped, solid members to pass therethrough into said barrel chamber in axial alignment with the axis of said barrel section, and said retractable piston comprising a retract lever which permits the piston to be manually retracted to within said piston chamber such that a shaped, solid member contained in said storage chamber may fall by gravity feed into said barrel chamber when said barrel chamber is empty.

* * * * *